US007927776B2

(12) United States Patent
Jeong et al.

(10) Patent No.: US 7,927,776 B2
(45) Date of Patent: Apr. 19, 2011

(54) TONER FOR ELECTROPHOTOGRAPHY

(75) Inventors: Jae-hyeuk Jeong, Suwon-si (KR); Hae-ree Joo, Seoul (KR); Kyung-yol Yon, Seongnam-si (KR)

(73) Assignee: Samsung Electronics Co., Ltd., Suwon-si, Gyeonggi-do (KR)

( * ) Notice: Subject to any disclaimer, the term of this patent is extended or adjusted under 35 U.S.C. 154(b) by 802 days.

(21) Appl. No.: 11/882,260

(22) Filed: Jul. 31, 2007

(65) Prior Publication Data

US 2008/0138736 A1 Jun. 12, 2008

(30) Foreign Application Priority Data

Dec. 8, 2006 (KR) ..... 10-2006-0125071

(51) Int. Cl.
*G03G 9/087* (2006.01)

(52) U.S. Cl. ..... 430/111.4

(58) Field of Classification Search ..... 430/111.4
See application file for complete search history.

(56) References Cited

U.S. PATENT DOCUMENTS 5,968,701 A * 10/1999 Onuma et al. ..... 430/108.22
7,638,251 B2 * 12/2009 Yamazaki et al. ..... 430/109.3

* cited by examiner

*Primary Examiner* — Janis L Dote
(74) *Attorney, Agent, or Firm* — Roylance, Abrams, Berdo & Goodman, L.L.P.

(57) ABSTRACT

A toner for electrophotography is provided that includes a binder resin, a colorant, a charge control agent, and a releasing agent, wherein the toner has a complex viscosity (η) of about $4.0\times10^1$ Pa·s to about $1.6\times10^3$ Pa·s at a temperature ranging from about 40° C. lower than a toner fixing temperature to about 10° C. higher than the toner fixing temperature and has a specified activation energy of 15 to 85 KJ/mol. By defining viscosity dependency in a linear modulus region of a toner and comprehensively defining thermal and rheological properties with respect to fixing conditions, a fixing phenomenon can be generalized and the quality of a toner can be evaluated.

10 Claims, No Drawings

TONER FOR ELECTROPHOTOGRAPHY

CROSS-REFERENCE TO RELATED PATENT APPLICATIONS

This application claims the benefit of Korean Patent Application No. 10-2006-0125071, filed on Dec. 8, 2006, in the Korean Intellectual Property Office, the disclosure of which is hereby incorporated by reference in its entirety.

BACKGROUND OF THE INVENTION

1. Field of the Invention

The present invention relates to a toner for electrophotography. More particularly, the invention relates to a toner for electrophotography having the required physical properties when thermally fixing an unfixed toner layer to obtain a stable image during printing.

2. Description of the Related Art

In an image forming apparatus such as an electrophotographic apparatus or an electrostatic recording apparatus, an electrostatic latent image is formed through light-exposure on a photoreceptor which is uniformly charged. A toner is attached to the electrostatic latent image, and a resulting toner image is transferred to a transfer medium such as a sheet of paper. Then, an unfixed toner image is fixed on the transfer medium through several processes such as heating, pressing, solvent steaming, and so on. In most fixing processes, the transfer medium with the toner image passes through fixing rollers and pressing rollers, and by heating and pressing, the toner image is fused on the transfer medium. Toner is fixed on the transfer medium according to fixing conditions to form a stable image.

In a thermal fixing method in which a heat roller or film is used, the surface of the heat roller or film contacts the toner image on a fixing sheet. In this case, a high heat efficiency is required to melt and attach the toner image on the fixing sheet. In the thermal fixing method, it is necessary to increase the heat capacity of a heat fixing means to avoid a fixing failure caused by passage of the fixing sheet and fixing at a low temperature. To realize low power consumption while retaining the fixing property of a toner, toner performances, particularly the fixing property of toner at a low temperature should be improved.

For example, in a fixing step of a pressure-thermal fixing method, hot rollers, under pressure, contact a toner image which is in a melted state. Thus, some of the toner is transferred from the paper and is attached to the surface of the fixing roller, and then transferred to a fixing sheet, resulting in contamination of the fixing sheet. This is called as "offset" and is significantly affected by fixing rate and temperature. Generally, if the temperature of the fixing roller surface is low then the fixing rate is slow and if the temperature of the fixing roller surface is high then the fixing rate is fast. This is because a fixed amount of energy is supplied to a toner image to fix the toner image regardless of fixing rates.

To solve such problems, the fixing temperature is generally increased to facilitate fixing a toner on a fixing sheet to ensure the fixing rate is fast. According to this method, the temperature of heat rollers can be somewhat lowered to avoid offset of a top toner layer at a high temperature. However, when very high shear force is applied to the toner layer, problems such as winding offset in which a fixing sheet winds around fixing rollers and marks from separating means for separating the fixing sheet from the rollers generated in a fixed image, etc. are caused.

Korean Patent No. 138,583, Korean Patent Laid-Open Publication No. 2001-083034, and Korean Patent Laid-Open Publication No. 1999-063467 disclose toners for electrophotography having specific rheological properties. However, they fail to obtain both of superior fixing property and anti-offset property. Thus, there is need for a technology that can predict the behavior of a toner under heat and pressure to improve a fixing property and prevent offset.

SUMMARY OF THE INVENTION

The present invention provides a toner for electrophotography having an improved fixing property and which prevent offset by having modified rheological properties compared to the prior toners.

According to an aspect of the present invention, a toner for electrophotography is provided including a binder resin, a colorant, a charge control agent, and a releasing agent, wherein the toner has a complex viscosity ($\eta$) of $4.0\times10^1$ Pa·s to $1.6\times10^3$ Pa·s at a temperature ranging from about 40° C. lower temperature than a toner fixing temperature to about 10° C. higher temperature than the toner fixing temperature and has a specified activation energy of 15 to 85 KJ/mol.

These and other aspects of the invention will become apparent from the following detailed description of the invention which discloses various embodiments of the invention.

DETAILED DESCRIPTION OF THE INVENTION

The present invention provides a toner for electrophotography including a binder resin, a colorant, a charge control agent, and a releasing agent, wherein the toner has a complex viscosity ($\eta$) of $4.0\times10^1$ Pa·s to $1.6\times10^3$ Pa·s at a temperature ranging from about 40° C. lower than a toner fixing temperature to a temperature of about 10° C. higher than the toner fixing temperature and has a specified activation energy of 15 to 85 KJ/mol.

By adjusting or modifying the complex viscosity and the specified activation temperature (activation energy) of the toner, the temperature-dependencies of the releasing property and the amount of toner loaded on an image in a fixing step can be reduced and image contamination can be decreased.

When the toner has a complex viscosity ($\eta$) less than $4.0\times10^1$ Pa·s, a cohesion of the binder resin is significantly reduced to cause offset when used in a high temperature range. When the toner has a complex viscosity ($\eta$) greater than $1.6\times10^3$ Pa·s, cohesion of the binder resin is too high to obtain the surface gloss and proper fixing strength of a fixed image. In particular, when the complex viscosity ($\eta$) is $4.0\times10^1$ Pa·s to $8.0\times10^2$ Pa·s, the toner has a high fixing strength, but causes contamination. When the complex viscosity ($\eta$) is $8.0\times10^2$ Pa·s to $1.6\times10^3$ Pa·s, the toner does not cause contamination, but has a low fixing strength. In one embodiment, the complex viscosity is about $8.0\times10^2$ Pa·s to about $1.6\times10^3$ Pa·s.

The specified activation temperature is a numerical value representing a viscosity variation with respect to changes in temperature. A toner having the appropriate and desired properties can be designed through the specified activation energy. According to an embodiment of the present invention, when the specified activation energy is less than 15 KJ/mol, the sensitivity of viscosity variation with respect to varied temperature is too low. Thus, a toner having a low viscosity has poor powder strength and a toner having a high viscosity exhibits a fixing strength or has physical properties which are difficult to manage. When the specified activation energy is greater than 85 KJ/mol, the sensitivity of viscosity variation with respect to changes in temperature is high, and thus, a toner has a preferred powder/liquid behavior, but does not have a desired viscosity at a selected temperature and other rheological properties.

The temperature-dependency of viscosity may be calculated according to the Arrhenius Equation or WLF equation (Williams, Landel, Ferry Equation). Applications are divided according to a glass transition temperature (Tg) of a sample and a measured temperature. The viscosity and the specified activation energy can be obtained using the following Equation 1.

$$\eta(T)=\eta(T_0)\mathrm{Exp}[U/R*(1/T-1/T_0)] \quad \text{Equation 1}$$

In the above equation, η is a viscosity, T is a temperature, $T_0$ is a reference temperature, U is a specified activation energy, and R is the gas constant.

The viscosity is measured at a temperature ranging from about 40° C. lower than a toner fixing temperature of a fixing unit to a temperature of about 10° C. higher than the toner fixing temperature of a fixing unit and at a rotation angular velocity of heating rollers of the fixing unit wherein general Newtonian viscosity is not applied. The temperature-dependency of viscosity is expressed by the specified activation energy. Thus, the equation represents the sensitivity of a material to temperature in the concept of energy.

The angular velocity of the fixing unit may be about 5 to 10 rad/s when measuring the complex viscosity. A dynamic viscoelasticity may be determined using a temperature dispersion measurement by sinusoidal vibration in a frequency range of about 5 to 10 rad/s through an ARES apparatus manufactured by Rheometric Scientific.

The stress relaxation means a force required for maintaining reduction in strain with respect to time when a predetermined strain is applied to a toner. It represents a variation in elastic modulus with respect to time in which a toner stays on a fixing unit.

Herein, the stress relaxation is determined to confirm a time-dependency of viscoelasticity with respect to a fixing condition even when a toner has a desired viscosity. This is because the fixing condition does not depend only on the viscosity determined when a toner shows a stable viscoelastic behavior after a certain time but also on a viscoelasticity for a very short time before stabilization.

According to an embodiment of the present invention, even when a toner has a desired viscosity, the stress relaxation may be about 300 to about 1,000 Pa·s at a temperature of 10° C. lower than a toner fixing temperature for a dwell time. When the stress relaxation is less than 300 Pa·s, the cohesion of a liquid toner is low, resulting in contamination of the print medium. Stress relaxation greater than 1,000 Pa·s is not preferable due to the relatively strong elastic force.

Loss tangent, tan δ representing a ratio of loss elastic modulus G"/a storage elastic modulus G' of a toner may be less than 1 and the storage elastic modulus may be greater than about $3.0\times10^2$ dyn/cm$^2$. The storage elastic modulus G' is related to the elasticity of a toner and the loss elastic modulus G" is related to the plasticity of a toner. Thus, when the storage elastic modulus increases, the elasticity of a toner increases. When loss elastic modulus increases, the plasticity of the toner increases. To maintain sufficient gloss of a fixed image, it is important to adjust a ratio of elasticity to plasticity while maintaining a desired elasticity. When tan δ is greater than 1 or the storage elastic modulus is less than $3.0\times10^2$ dyn/cm$^2$, the elasticity of a toner is deteriorated, resulting in contamination or wrap jam.

When a toner has a low elasticity and a high plasticity, the releasing property of the toner from rollers by elasticity is poor, resulting in contamination, or the viscosity of the toner itself is reduced to cause an unbalance of adhesion between sheets of paper, strength of the toner itself, and the adhesion to H/R.

The toner forms an image through charging, exposing, developing, transferring, fixing, cleaning and erasing steps. The range of desired physical properties of a toner may be determined in the developing step before the fixing step. To attain stable physical properties in a developing unit, the primary and secondary phase transition temperatures of a toner may be about 60° C. or higher and the heat capacity required for phase transition may be greater than 110 J/g. Herein, the phase transition includes both a variation in the base line due to the secondary phase transition by Tg of a binder resin, etc. and the primary phase transition by melting of wax, etc., and is an area of peaks shown when measuring a heat capacity on differential scanning calorimeter (DSC).

When the phase transition temperature is lower than 60° C. or the heat capacity required for phase transition is less than 110 J/g, a toner is coagulated or thermal stability of a toner to a peripheral component such as a blade may be reduced to cause abnormal behavior such as streaks.

The heat capacity is calculated by scanning temperature on DSC and integrating a peak area of measured heat capacity and an onset point is also determined from a temperature at which a peak is generated or inflection is initiated.

According to an embodiment of the present invention, interrelation between the thermal property and rheological property of a toner can be comprehensively defined to generalize a fixing process and to evaluate the quality of the toner.

A binder resin used in the toner for development according to an embodiment of the present invention may be various resins known in the art. Suitable resins include, for example, styrene-based copolymers such as polystyrene, poly-p-chlorostyrene, poly-α-methylstyrene, styrene-chlorostyrene copolymer, styrene-propylene copolymer, styrene-vinyltoluene copolymer, styrene-vinyl naphthalene copolymer, styrene-methyl acrylate copolymer, styrene-ethyl acrylate copolymer, styrene-propyl acrylate copolymer, styrene-butyl acrylate copolymer, styrene-octyl acrylate copolymer, styrene-methyl methacrylate copolymer, styrene-ethyl methacrylate copolymer, styrene-propyl methacrylate copolymer, styrene-butyl methacrylate copolymer, styrene-α-methyl chloromethacrylate copolymer, styrene-acrylonitrile copolymer, styrene-vinyl methyl ether copolymer, styrene-vinyl ethyl ether copolymer, styrene-vinyl ethyl ketone copolymer, styrene-butadiene copolymer, styrene-acrylonitrile-indene copolymer, styrene-maleic acid copolymer, styrene-maleic ester copolymer; and polymethyl methacrylate, polyethyl methacrylate, polybutyl methacrylate, and copolymers thereof, polyvinyl chloride, polyvinyl carboxylate, polyethylene, polypropylene, polyester, polyurethane, polyamide, epoxy resin, polyvinyl butyral resin, rosin, modified rosin, terpene resin, phenol resin, aliphatic or alicyclic hydrocarbon resin, aromatic petroleum resin, chlorinated paraffin, paraffin wax, and the like. These resins may be used alone or in combination. Polyester-based resins are suitable for a color developing agent due to the good fixing property and clearness.

The binder resins are selected to produce the toner having the desired complex viscosity and specified activation energy. The binder resin is included in the toner in an amount to provide the complex viscosity and activation energy. In one embodiment, the binder resin is a mixture of hard high molecular weight resin and a softer lower molecular weight resin. In another embodiment, the binder resin is a mixture of a first resin and a second resin where the first resin has a higher molecular weight than the molecular weight of the second resin. The higher molecular weight resin can have a weight average molecular weight of about 60,000 to 100,000. In one embodiment, the higher molecular weight binder resin has a weight average molecular weight of about 80,000. The lower molecular weight binder resin can have a weight average molecular weight in a range of about 3,000 to 7,000. In one embodiment, the lower molecular weight binder resin can have a weight average molecular weight of about 5,000. The weight ratio of the higher molecular weight to lower molecular weight binder resin can be about 8:2. In another embodiment, the binder resin can include about 75% to 85% of the high molecular weight resin and about 15% to 25% of the low molecular weight resin.

A colorant may be carbon black or aniline black for a black toner. A non-magnetic toner according to an embodiment of the present invention is suitable for a color toner. Carbon black is generally used as a black colorant. To make colors, yellow colorant, magenta colorant, and cyan colorant may be further included.

The yellow colorant may comprise condensed nitrogen compounds, isoindolinone compounds, anthraquinone compounds, azo metal complexes, or allyl imide compounds. Specific examples of such yellow colorants include C.I. Pigment Yellow 12, 13, 14, 17, 62, 74, 83, 93, 94, 95, 109, 110, 111, 128, 129, 147, 168, 180, and the like.

The magenta colorant may comprise condensed nitrogen compounds, anthraquinone compounds, quinacridone compounds, lake compounds of basic dyestuffs, naphthol compounds, benzo imidazole compounds, thioindigo compounds, or pherylene compounds. Specific examples of such magenta colorants include C.I. Pigment Red 2, 3, 5, 6, 7, 23, 48:2, 48:3, 48:4, 57:1, 81:1, 122, 144, 146, 166, 169, 177, 184, 185, 202, 206, 220, 221 and 254.

The cyan colorant may comprise copper phthalocyanine compounds and derivatives thereof, anthraquinone compounds, or lake compounds of basic dyestuffs. Specific examples of such cyan colorants include C.I. Pigment Blue 1, 7, 15, 15:1, 15:2, 15:3, 15:4, 60, 62 and 66.

These colorants may be used alone or in combination. A desired colorant is selected considering the desired color, saturation, brightness, weather resistance, and dispersity in a toner.

The amount of the colorant may be about 0.1 to about 20 parts by weight based on 100 parts by weight of the binder resin. When the amount of the colorant is less than 0.1 part by weight based on 100 parts by weight of the binder resin, the coloring effect is not sufficient. When the amount of the colorant is greater than 20 parts by weight, costs of producing a toner increases and friction charging quantity is not sufficiently obtained.

Examples of a chain transfer agent include, but are not restricted to: sulfur-containing compounds such as dodecanethiol, thioglycolic acid, thioacetic acid and mercaptoethanol; phosphorous acid compounds such as phosphorous acid and sodium phosphorate; hypophosphorous acid compounds such as hypophosphorous acid and sodium hypophosphorate; and alcohols such as methyl alcohol, ethyl alcohol, isopropyl alcohol and n-butyl alcohol.

Examples of a polymerization initiator include persulfates such as potassium persulfate and ammonium persulfate; azo compounds such as 4,4-azobis(4-cyanovaleric acid), dimethyl-2,2'-azobis(2-methylpropionate), 2,2-azobis(2-amidinopropane) dihydrochloride, 2,2-azobis-2-methyl-N-1,1-bis (hydroxymethyl)-2-hydroxyethylpropioamide, 2,2'-azobis (2,4-dimethylvaleronitrile), 2,2'-azobisisobutyronitrile, and 1,1'-azobis(1-cyclohexanecarbonitrile); and peroxides such as methyl ethyl peroxide, di-t-butyl peroxide, acetyl peroxide, dicumyl peroxide, lauroyl peroxide, benzoyl peroxide, t-butyl peroxy-2-ethylhexanoate, di-isopropylperoxy dicarbonate, and di-t-butyl peroxy isophthalate. An oxidation-reduction initiator, which is a combination of the polymerization initiator and a reducing agent, may also be used.

A releasing agent may be used to protect a photoconductor and to prevent deterioration of development properties, thereby obtaining a high quality image. The releasing agent according to an embodiment of the present invention may be a highly pure solid fatty acid ester-based material. Examples of such a releasing agent include low molecular weight polyolefins such as low molecular weight polyethylene, low molecular weight polypropylene, and low molecular weight polybutylene; paraffin wax; and polyfunctional ester compounds, and the like. In an embodiment of the present invention, a polyfunctional ester compound composed of alcohol having at least trifunctionality and carboxylic acid may be used as the releasing agent.

A charge control agent may be selected from the group consisting of salicylic acid containing a metal such as zinc or aluminum, boron complex of bis diphenyl glycolic acid, and silicate. Specific examples of such a charge control agent include zinc dialkyl salicylate, boro bis(1,1-diphenyl-1-oxoacetyl) potassium salt, and the like.

The wax may be any suitable wax which provides the desired property of the final toner composition. Examples of useful waxes include, but are not restricted to, polyethylene-based wax, polypropylene-based wax, silicone wax, paraffin-based wax, ester-based wax, Carnauba wax and metallocene wax. The melting point of wax may be about 50 to 150° C. Wax components physically adhere to toner particles, but do not covalently bond to toner particles. A toner is provided which is fixed on a final image receptor at a low fixing temperature and shows good final image durability and abrasion resistance. The amount and type of wax is selected to produce a toner composition having the desired complex viscosity and specified activation energy. The wax is generally included in an amount of about 1% to 5% by weight. In one embodiment, the wax is included in an amount of about 3 wt % based on the weight of the toner.

A typical electrophotographic image forming process includes a series of steps of forming an image on a receptor, including charging, exposing, developing, transferring, fixing, cleaning and erasing steps.

In a charging step, a photoconductor is positively or negatively charged by corona or charging rollers. In an exposing step, an optical system, typically a laser scanner or diode array selectively discharges the surface of the charged photoconductor in an imagewise manner to correspond to a desired image to be formed on the final image receptor, thereby forming a latent image. Electromagnetic radiation which is referred to as "light" may include, for example, infrared radiation, visible ray and ultraviolet radiation.

In a developing step, polar toner particles contact with the latent image on the photoconductor in which a developing unit having the same potential polarity as a toner polarity, typically electrically-biased, is used. Toner particles are transferred to the photoconductor and selectively attached to the latent image by electrostatic force to form a toner image on the photoconductor.

In the transferring step, the toner image is transferred to a desired final image receptor from the photoconductor. An intermediate transferring element is sometimes used to affect transferring of the toner image from the photoconductor to the intermediate transferring element and subsequently transferring to the final image receptor.

In a fixing step, the toner image on the final image receptor is heated to soften or melt toner particles, thereby the toner image can be fixed on the final receptor. Another fixing method includes fixing a toner on a final receptor under a high pressure with or without applying heat.

In a cleaning step, the remaining toner on the receptor is removed. Finally, in a charge-removing step, charges of the photoconductor are reduced to a substantially uniformly low value by exposure to light of a specific wavelength band. Thus, residues of an original latent image are removed and a photoconductor for the next image forming cycle is prepared.

The present invention will now be described in greater detail with reference to the following examples. The following examples are for illustrative purposes only and are not intended to limit the scope of the invention.

EXAMPLES

A high density hard resin having a weight average molecular weight of about 80,000 (hereinafter, referred to as "H"), a low density soft resin having a weight average molecular weight of about 5,000 (hereinafter, referred to as "L"), and a resin having a middle weight average molecular weight of about 20,000 (hereinafter, referred to as "M") were mixed in a controlled ratio to prepare a binder resin. Carnauba-based natural wax and polyethylene (PE), polypropylene (PP), etc. were used to conduct fine adjustment of the rheological property. A high viscosity toner was prepared using a material having an increased amount of the high molecular weight PET. A viscosity-dependent toner was prepared by adjusting the property thereof according to the amount of the low molecular weight resin and the type and the amount of wax. The compositions of the samples specifically used are provided in Table 1 where the amounts are parts by weight.

TABLE 1

| | Binder (ratio) | | | Wax |
|---|---|---|---|---|
| | H | M | L | PE (3%) |
| Example 1 | 8 | — | 2 | PE (3%) |
| Example 2 | 10 | — | | PE (3%) |
| Example 3 | 2 | 7 | 1 | PE (3%) |
| Example 4 | — | 10 | — | PE (3%) |
| Example 6 | 2 | 7 | 1 | PE (3%) |
| Example 7 | 2 | 7 | 1 | PP (2%) & PET (1%) |
| Example 8 | 2 | 7 | 1 | Natural PET (5%) |
| Example 9 | 7 | — | 3 | PE (3%) |
| Example 10 | 2 | 7 | 1 | Natural PET (2%) & high crystalline PE (1%) |
| Comparative Example 1 | — | — | 10 | |
| Comparative Example 2 | 8 | — | 2 | PE (5%) |
| Comparative Example 3 | 8 | — | 2 | PP (2%) & PET (1%) |
| Comparative Example 4 | 7 | — | 3 | Natural PET (5%) |
| Comparative Example 5 | 9 | — | 1 | PP (3%) |
| Comparative Example 6 | 2 | 7 | 1 | Natural PET (7%) |
| Comparative Example 7 | 8 | — | 2 | PP (3%) |
| Comparative Example 8 | 8 | — | 2 | Natural PET (2%) & high crystalline PE (1%) |
| Comparative Example 9 | 8 | — | 2 | Amorphous PE wax |

Temperature Dependency Test

The fixing property of toners was evaluated by printing at 33 PPM or more and the viscosity of samples and heat capacity were adjusted by the type of binder resin and a mixing ratio. Test was performed at a fixing temperature of 200° C.

Example 1 included a binder resin of H and L (H:L=8:2), Example 2 included a binder resin of only H, Example 3 included a binder resin of H, M and L (H:M:L=2:7:1), Example 4 included a binder resin of only M, and Comparative Example 1 included a binder of only L. The results are shown in Table 2.

TABLE 2

| | Viscosity (Pa · s) | | |
|---|---|---|---|
| | 160° C. | 180° C. | 190° C. |
| Example 1 | 1521 | 125 | 53 |
| Example 2 | 1533 | 1020 | 752 |
| Example 3 | 393 | 91 | 43 |
| Example 4 | 297 | 131 | 95 |
| Comparative Example 1 | 55 | 22 | 13 |

The viscosity was measured using an ARES apparatus manufactured by Rheometric Scientific. The measurement was conducted for 30 seconds and within an error range of 1° C. after initiating the measurement to ensure precision. Samples were placed between two discs having a diameter 25 mm in a powder state and Newtonian viscosity was measured in a linear region.

The samples in a powder state are directly measured to exactly determine the physical properties of a toner by minimizing addition/removal of thermal hysteresis caused during preparing the samples. When a sample had an unstable normal stress, according to Cox-Mertz Rule, a complex viscosity was determined under the following condition: test angular velocity at a strain of 5% or less=rotation angular velocity of a fixing unit, instead of a dynamic viscosity.

The specified activation energy of each Example was calculated using the Arrhenius Equation and the results are provided in Table 3.

TABLE 3

| | Specified activation energy (kJ/mol) |
|---|---|
| Example 1 | 82.18 |
| Example 2 | 16.75 |
| Example 3 | 53.14 |
| Example 4 | 27.74 |
| Comparative Example 1 | 34.43 |

Referring to Table 3, the temperature-dependency of the viscosity of the samples is as follows: Example 1>Example 3>Comparative Example 1>Example 4>Example 2. Example 1 is most sensitive to temperature and Example 2 is least sensitive to temperature. The viscosity may be calculated using the Arrhenius equation according to temperature.

Stress Relaxation Test

Since viscosity is dependant on temperature and strain, it should include an element according to time. In the case of contamination, a toner is viscoelastic as well as viscous. A fixing condition depends on stabilization of physical properties of a toner (time transient phenomena). Thus, these elements should be considered to exactly define the physical properties of a desired toner.

To define more specific physical properties of Examples 1 and 3 having satisfactory fixing/contaminating properties with respect to viscosity, samples having different viscoelasticity in a similar viscosity region were prepared and tested. The samples were prepared in the same manner as in Examples 1 and 3 except that the amount of resins and the type and the amount of wax were changed. The viscoelasticity of the resulting samples was determined.

The samples were prepared by adjusting the content ratio of a high molecular weight/low molecular weight PET and the molecular weight/molecular weight distribution of wax as provided in Table 1. Example 6 included a binder resin of H, M and L (H:M:L=2:7:1) and 3% PE wax, Example 7 included 2% PP wax and 1% natural PET wax, Comparative Example 2 included a binder resin of H and L (H:L=8:2) and 5% PE wax, and Comparative Example 3 included 2% PP wax and 1% natural PET wax.

Samples having a specific activation energy of 15 to 85 KJ/mol were selected from samples having a viscosity greater than 50 Pa·s and less than 1,500 Pa·s at 190° C., and then were subjected to a stress relaxation test. Samples were tested in a powder state as in a dynamic test and a gap of about 1 mm was set at 5% strain. The results are provided in Table 4.

TABLE 4

| | Stress relaxation G(t): Pa | Note |
|---|---|---|
| Example 6 | 445 | Partial contamination |
| Example 7 | 730 | Partial contamination |
| Comparative Example 2 | 1230 | Partial fixing |
| Comparative Example 3 | 1390 | Partial fixing |

Referring to Table 4, Comparative Examples 2 and 3 had a stress relaxation greater than 1,000 Pa·s, resulting in poor fixing. Partial contamination of Examples 6 and 7 was detected.

Fixing and contamination properties on certain media were good in a stress relaxation range of 300 to 1,000 Pa. However, these toners had a partial contamination and had a decreased fixing property on other media having other basis weight and type (coated paper, OHP, cotton paper, etc.). Such deterioration in physical properties is caused by disharmony between a storage elastic modulus and a loss elastic modulus of a toner. To obtain a range of physical properties according to a used paper, separate samples were prepared.

Storage Elastic Modulus and Loss Elastic Modulus Test

Toners were prepared by adjusting the acidity and the weight average molecular weight distribution (MWD) of resins. Comparative Examples 4 and 5 and Example 9 included the hard resin having a narrow region of MWD. MWD was adjusted to be 20 or less and samples had a different content ratio of H/L.

Comparative Example 4 had a H:L ratio of 7:3, an acidity of 20 and 5% wax, Example 5 had a H:L ratio of 9:1, an acidity of 10 and 3% wax, and Example 9 had a H:L ratio of 8:2, an acidity of 20 and 3% wax. MWD of samples is as follows: Comparative Example 4>Example 9>Comparative Example 5.

Example 8 included a binder resin of H, M and L (H:M:L=2:7:1) with a MWD of H of about 5, an acidity of 10 to 20, and 5% wax and Comparative Example 6 had a MWD of 20 or more, an acidity of 10 to 20, and a wax content of 7%.

A storage elastic modulus and a loss elastic modulus were determined at 210° C., an angular velocity of 7 rad/s, and a strain of less than 5%. The results are provided in Table 5.

TABLE 5

| | G' (Pa) | G'' (Pa) | Viscosity | Note |
|---|---|---|---|---|
| Comparative Example 4 | 205 | 413 | $40 < \eta < 80$ | Partial contamination |
| Example 8 | 350 | 225 | $40 < \eta < 80$ | — |
| Comparative Example 5 | 897 | 489 | $\eta > 100$ | Partial fixing |
| Example 9 | 431 | 750 | ~80 | |
| Comparative Example 6 | 305 | 85 | $\eta < 40$ | Partial contamination |

Referring to Table 5, Comparative Examples 4 and 6 had a tendency for contamination, but exhibited low G' and relatively low viscosity. Thus, the ability of the toner to separate from a sheet of paper and the cohesion of the toner were decreased which caused contamination of the medium.

In particular, Comparative Example 4 had a proper viscosity, but exhibited a low G' value, which decreased the releasing property between a roller and a toner, resulting in contamination of the medium. However, Comparative Example 6 had too low viscosity and thus decreased cohesion of a toner itself in spite of proper G' value, resulting in partial contamination of the medium.

Example 8 and Comparative Example 5 had a tan $\delta$(G''/G') <1, an absolute storage elastic modulus G' of 300 Pa or more, and a complex viscosity of 40 Pa·s or more. Example 8 had relatively low viscosity to exhibit a satisfactory fixing property and had separating ability from a sheet of paper at an absolute G' value and a tan $\delta$(G''/G')<1, resulting in relatively good fixing. Comparative Example 5 had a high viscosity to exhibit a good contamination property, but had poor fixing strength.

Example 9 had a proper storage elastic modulus, a viscosity of about 80 and tan $\delta$>1, which indicates stable behavior to contamination and fixing properties.

Measurement of Heat Capacity

Storage stability or streak results from various physical factors. Thermal stability of a resin was determined. Examples 8 and 9 were restricted in further detail to determine properties in developing before fixing.

Example 10 included the same binder resin as in Example 8 and 2% natural PET wax and less than 1% high crystalline PE. Comparative Example 8 included the same binder resin as in Example 9 and 2% natural PET wax and less than 1% high crystalline PE. These systems exhibited different heat capacity due to different compatibility to wax. Comparative Example 7 included the same system as in Example 9 and a PP wax and Comparative Example 9 included an amorphous PE wax.

Heat capacity was determined by TA DSC. When heat capacity relatively represented the properties of materials, the relevant function was applied thereto by expressing numerically with respect to certain temperature regions. The results are provided in Table 6.

TABLE 6

| | Heat Capacity (J/g) | Onset point of primary and secondary phase transition |
|---|---|---|
| Comparative Example 7 | 75.85 | 69.23 |
| Example 10 | 110.2 | 62.45 |
| Comparative Example 8 | 87.45 | 64.95 |
| Comparative Example 9 | 60.5 | 59.4 |

Referring to Table 6, Comparative Example 7 had a relatively high phase transition temperature, and thus exhibited storage stability and development stability. In this case, it is difficult to obtain a sample having a satisfactory fixing property to various print media. That is, rheological property of a sample is restricted.

Example 10 and Comparative Example 8 had similar onset temperatures. However, Example 10 had a greater range of the heat capacity peak and exhibited more stable behavior than Comparative Example 8, which results in powder stability since heat capacity required for phase transition is relatively high.

Comparative Example 9 exhibited streaking. This is because the phase transition more easily occurs than the other samples due to low primary and secondary transition point and low energy required for phase transition, and the mechanical strength is poor. It is understood that adherence of a toner is increased due to cohesion of the toner and a peripheral component such as a blade to cause abnormal behavior such as streaking.

Fixing and Contamination Test

A fixing property was evaluated through a tape test and the level of releasing was recorded: ○-90% or more, Δ-80 or more, and x-70% or less. The contamination level of a fixing unit was also determined by visual inspection and recorded as ○, Δ, x. The fixing property and contamination characteristic of each example are provided in Table 7.

TABLE 7

| | Fixing | Contamination (offset) | Streak |
|---|---|---|---|
| Example 1 | Δ | ○ | — |
| Example 2 | x | ○ | — |
| Example 3 | ○ | Δ | — |
| Example 4 | x | ○ | — |
| Example 6 | ○ | Δ | — |
| Example 7 | ○ | Δ | — |
| Example 8 | ○ | ○ | — |
| Example 9 | ○ | ○ | — |
| Example 10 | ○ | ○ | ○ |
| Comparative Example 1 | ○ | x | — |
| Comparative Example 2 | Δ | ○ | — |
| Comparative Example 3 | Δ | ○ | — |
| Comparative Example 4 | ○ | Δ | — |
| Comparative Example 5 | Δ | ○ | — |
| Comparative Example 6 | ○ | Δ | — |
| Comparative Example 7 | Δ | ○ | ○ |
| Comparative Example 8 | ○ | ○ | Δ |
| Comparative Example 9 | ○ | ○ | x |

Referring to Table 7, Comparative Examples 2, 3, 5 and 7 did not exhibited sufficient rheological property to perform a desired shaping in a fixing unit, which indicated a poor fixing property due to decrease in bonding force between toners or between a toner and a paper. Comparative Examples 4 and 6 resulted in contamination due to insufficient cohesion of the toner and poor elasticity/viscoelasticity balance.

Comparative Examples 8 and 9 exhibited streaks. Streaks in a developing unit are analyzed through thermal stability of a toner and are serious when the phase transition temperature and energy required for phase transition are too low.

According to the present invention, by defining viscosity dependency in a linear modulus region of a toner and comprehensively defining thermal and rheological properties with respect to fixing conditions, a fixing phenomenon can be generalized, the fixing property of a toner can be improved and contamination can be prevented.

While the present invention has been particularly shown and described with reference to exemplary embodiments thereof, it will be understood by those of ordinary skill in the art that various changes in form and details may be made therein without departing from the spirit and scope of the present invention as defined by the following claims.

What is claimed is:

1. A toner for electrophotography comprising a binder resin, a colorant, a charge control agent, and a releasing agent, wherein the toner has a complex viscosity (η) of $4.0\times10^1$ Pa·s to $1.6\times10^3$ Pa·s within a temperature range of about 40° C. lower than a toner fixing temperature of a toner fixing unit to about 10° C. higher than the toner fixing temperature of the fixing unit and has a specified activation energy of 15 to 85 KJ/mol, wherein the binder resin is a mixture of a first resin and a second resin where the first resin has a weight average molecular weight of about 60,000 to 100,000 and said second resin has a weight average molecular weight of about 3,000 to 7,000.

2. The toner for electrophotography of claim 1, wherein an angular velocity of the fixing unit is about 5 to 10 rad/s.

3. The toner for electrophotography of claim 1, wherein a stress relaxation of the toner is about 300 to about 1,000 Pa·s at a temperature 10° C. lower than the toner fixing temperature.

4. The toner for electrophotography of claim 1, wherein the complex viscosity (η) is $4.0\times10^1$ Pa·s to about $8.0\times10^2$ Pa·s.

5. The toner for electrophotography of claim 1, wherein the complex viscosity (η) is about $8.0\times10^2$ Pa·s to $1.6\times10^3$ Pa·s.

6. The toner for electrophotography of claim 1, wherein primary and secondary phase transition temperatures of the toner are 60° C. or higher and a heat capacity required for the first and second phase transition is greater than 110 J/g.

7. The toner for electrophotography of claim 1, wherein the binder resin is included in an amount to provide the complex viscosity and specified activation energy.

8. The toner for electrophotography of claim 1, wherein the binder resin comprises the first high molecular weight resin and the second low molecular weight resin in a ratio of about 8:2.

9. The toner for electrophotography of claim 1, wherein the releasing agent is a wax in an amount to provide the complex viscosity and specified activation energy.

10. The toner for electrophotography of claim 9, wherein the wax is included in an amount of about 1% to 5% based on the weight of the toner.

* * * * *